US012553695B2

(12) United States Patent
Grace

(10) Patent No.: US 12,553,695 B2
(45) Date of Patent: Feb. 17, 2026

(54) ARCHERY BROADHEAD AND RELATED METHOD OF USE

(71) Applicant: Grace Engineering Corp., Memphis, MI (US)

(72) Inventor: Nathaniel E. Grace, Fort Gratiot, MI (US)

(73) Assignee: Grace Engineering Corp., Memphis, MI (US)

( * ) Notice: Subject to any disclaimer, the term of this patent is extended or adjusted under 35 U.S.C. 154(b) by 157 days.

(21) Appl. No.: 18/406,928

(22) Filed: Jan. 8, 2024

(65) Prior Publication Data

US 2025/0224217 A1 Jul. 10, 2025

(51) Int. Cl.
*F42B 6/08* (2006.01)

(52) U.S. Cl.
CPC ..... *F42B 6/08* (2013.01)

(58) Field of Classification Search
CPC ..... F42B 6/08
See application file for complete search history.

(56) References Cited

U.S. PATENT DOCUMENTS 5,564,713 A * 10/1996 Mizek ..... F42B 6/08 473/583
6,935,976 B1 8/2005 Grace, Jr. et al.
7,234,220 B1 * 6/2007 Grace, Jr. ..... F42B 6/08 29/434
7,771,298 B2 8/2010 Pedersen
7,905,802 B2 * 3/2011 Erhard ..... F42B 6/08 473/583
8,197,367 B2 6/2012 Pulkrabek et al.
8,398,510 B1 * 3/2013 Mizek ..... F42B 6/08 473/583
8,469,842 B2 6/2013 Mizek et al.
8,469,843 B2 6/2013 Mizek et al.
8,911,311 B1 12/2014 Mizek et al.
8,986,141 B2 3/2015 Pedersen
9,068,806 B2 6/2015 Pedersen
9,170,078 B2 10/2015 Pedersen
D745,619 S 12/2015 Pedersen
9,404,722 B2 8/2016 Pedersen
9,410,778 B2 8/2016 Pedersen
9,605,933 B2 3/2017 Pedersen
10,623,808 B2 4/2020 Pedersen

* cited by examiner

*Primary Examiner* — John A Ricci
(74) *Attorney, Agent, or Firm* — Warner Norcross + Judd LLP

(57) ABSTRACT

An expandable broadhead is provided with a ferrule defining a slot within which one or more blades are moveably mounted to a pin. A retainer in the slot can secure the blades in a closed mode when an arrow associated with the broadhead is shot from an archery bow. The retainer can include a dimple and a blade can include a retainer hole within which the dimple nests to secure the blade. The retainer hole can be common with and/or extend from a mass reducing opening defined by the blade. The dimple can ride over contours of the blade on a path to enter the hole with significantly less force than that to release the dimple and retainer from, and deploy, the blade. The slot can increase in depth beyond the dimple to reduce frictional engagement of the blades with slot sidewalls during deployment. A related method is provided.

20 Claims, 12 Drawing Sheets

ARCHERY BROADHEAD AND RELATED METHOD OF USE

BACKGROUND OF THE INVENTION

The present invention relates to expandable broadheads for use in archery, and more particularly to an expanding broadhead including a retainer that engages blades within a ferrule of the broadhead to secure the blades in a retracted mode and release the blades to a deployed mode.

Mechanical archery broadheads are designed to travel with an associated in-flight arrow in a retracted mode, in which associated blades are retracted, and to eventually convert to a deployed mode, in which the blades deploy, typically exposing cutting edges of the blades to a target or game. An issue arises, however, upon launch of the broadhead and associated arrow from an archery bow, when significant forces are exerted on the arrow and broadhead. These exerted forces can inadvertently cause one or more blades of the broadhead to transition from the retracted mode to the deployed mode. This can negatively affect the aerodynamic performance of the broadhead and/or cause the arrow and/or broadhead to alter a center of mass of the projectile. In turn, either of these can cause the arrow and associated broadhead to change trajectory, which can result in poor shot placement and/or unsatisfactory engagement with a target.

Many conventional mechanical broadheads use an O-ring to secure the blades in the retracted mode during launch and arrow flight. When the broadhead strikes the target, the O-ring moves, tears or rips to allow the blades to deploy. Some mechanical broadheads alternatively use a spring mounted between blades in a broadhead to push the blades outward against walls of the broadhead, thereby using friction to hold the blades in the retracted mode. While this spring works in several applications, it can work too well in some, creating too much friction so that the blades do not properly deploy upon engagement with a target. The blades also can be rather hard to convert from the deployed mode back to the retracted mode due to the spring, in cases where the broadhead is reused after deployment. Further, such springs frequently are secured to and move with the blades, which can damage the springs in some cases, reducing the opportunity to reuse the broadhead without replacing the spring. This can reduce the number of practical uses of the broadhead without disassembly and/or replacement of parts.

Accordingly, there remains room for improvement in the field of expandable broadheads, particularly in connection with a system that maintains blades in the retracted mode during launch and flight of an associated arrow, and that cleanly and consistently facilitates transition of the blades to the deployed mode.

SUMMARY OF THE INVENTION

An expandable broadhead is provided with a ferrule defining a slot within which one or more blades are moveably mounted to a pin. A retainer in the slot can secure the blades in a closed mode when an arrow associated with the broadhead is shot from an archery bow.

In one embodiment, the retainer can include a dimple and a blade can include a retainer hole within which the dimple nests to secure the blade in a closed mode.

In another embodiment, the retainer hole can be common with and/or extend from an elongated opening defined by the blade. The elongated opening can be continuous with an inlet commonly extending to the retainer hole defined by the first blade. In some cases, the opening, inlet and retainer hole can be bounded by a common edge extending through all of these features.

In still another embodiment, each of the blades can include a cutting edge, an impact edge and a rearward edge opposite the cutting edge. The inlet and retainer hole can be defined distal and inwardly from all these edges, such that none of these edges are interrupted by the inlet and/or retainer hole.

In yet another embodiment, the slot can include a width and a depth. The blades can extend through the width and can be stacked side by side within the depth. The depth of the slot can include a first depth in a first region adjacent the tip of the ferrule, and a second depth rearward of the first depth in a second region. The second depth can be greater than the first depth. When the blades are released by the retainer from a closed mode to transition to an open mode, the impact edges and side surfaces of the blades can enter and move freely and with little friction in the second region, facilitating deployment.

In even another embodiment, the slot can include the width and the depth. The depth of the slot can vary from narrow to wide as the slot extends rearward from the tip.

In a further embodiment, the dimple can be disposed in a first region where the depth of the slot is narrow. The pin can extend through the ferrule in a second region where the depth of the slot is wide.

In still a further embodiment, the retainer can include a base and an arm. The ferrule can define a retainer recess forward of the slot. The arm can extend beyond the slot and into retainer recess. The blades can be absent from and/or do not extend into the retainer recess.

In yet a further embodiment, the dimple can be rearward of the retainer recess, and forward of the pin. The dimple can engage the blade forward of the pin and rearward of the tip, or generally between the pin and the tip.

In even a further embodiment, a method is provided. The method can include providing a ferrule defining a slot with a first blade movably disposed in the slot and a retainer, including a dimple disposed in the slot, the first blade including an impact edge, a cutting edge, a rearward edge opposite the cutting edge, and a ramp extending adjacent the cutting edge and transitioning to a side surface of the first blade, the first blade defining a retainer hole; moving the first blade so that the ramp engages the first dimple on a first path; and aligning the retainer hole with the dimple so that the dimple at least partially enters the retainer hole and secures the first blade in a closed mode.

In a further embodiment, the method can include moving the first blade so that the side surface engages the first dimple such that the first dimple rides along the side surface along the first path before aligning with the retainer hole.

In still a further embodiment, the method can include flexing an arm of the retainer as the first dimple moves on the first path. In some cases, the arm flexes more when the side surface engages the first dimple than when the ramp engages the first dimple.

In yet a further embodiment, the method can include deploying the first blade upon impact with a target. The blade can move relative to the dimple, such that the first dimple rides along a second path, different from the first path, out of the retainer hole and past the impact edge, distal from the ramp. In so doing, the blade can transition to an open mode.

In even a further embodiment, a first force is used to move the blade so that the dimple travels along the first path. A second force is used to move the blade so that the dimple travels along the second path. The first force is less than the second force. Thus, the force to convert the blade to the closed mode can be less than the force to deploy the blade from the closed mode to the open mode.

The current embodiments provide a broadhead and method in which blades can be efficiently and consistently maintained in a closed mode and deployed to an open mode. Where included, the retainer can provide a precise, tunable, reliable, reusable mechanism to control movement of blades that move relative to a pin. With varying depths of the slot in different regions along the slot, friction on the blade is reduced to avoid "grabbing" of the blade during deployment to an open mode. The varying depths of the slot can increase the side force of the retainer to secure the blade in the closed mode, while allowing the blade to freely open upon engagement with a target and/or game. Where included, the dimple can ride over contours of the blade along a path to enter the hole with significantly less force than that to release the dimple and retainer from, and deploy, the blade.

These and other objects, advantages, and features of the invention will be more fully understood and appreciated by reference to the description of the current embodiment and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and are being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DETAILED DESCRIPTION OF THE CURRENT EMBODIMENTS

A current embodiment of the broadhead is shown in FIGS. 1-12 and generally designated 10. The broadhead as shown can be an expandable broadhead in the form of any type of arrowhead that opens, expands and/or moves from a closed mode to an open mode. As used herein, a closed mode can refer to a retracted mode in which the blades of the broadhead are generally retracted, forming a smaller cutting diameter or area, whereas the term open mode can refer to a deployed mode, where the blades of the broadhead generally open or deploy, forming a large cutting diameter or area to effectively engage a target and/or game. Generally, the broadhead remains in the closed mode during launch of an arrow 100 to which the broadhead 10 is joined, and within or during flight. The broadhead can open to the open mode or deployed mode upon impact with a target or game.

Figure 8:
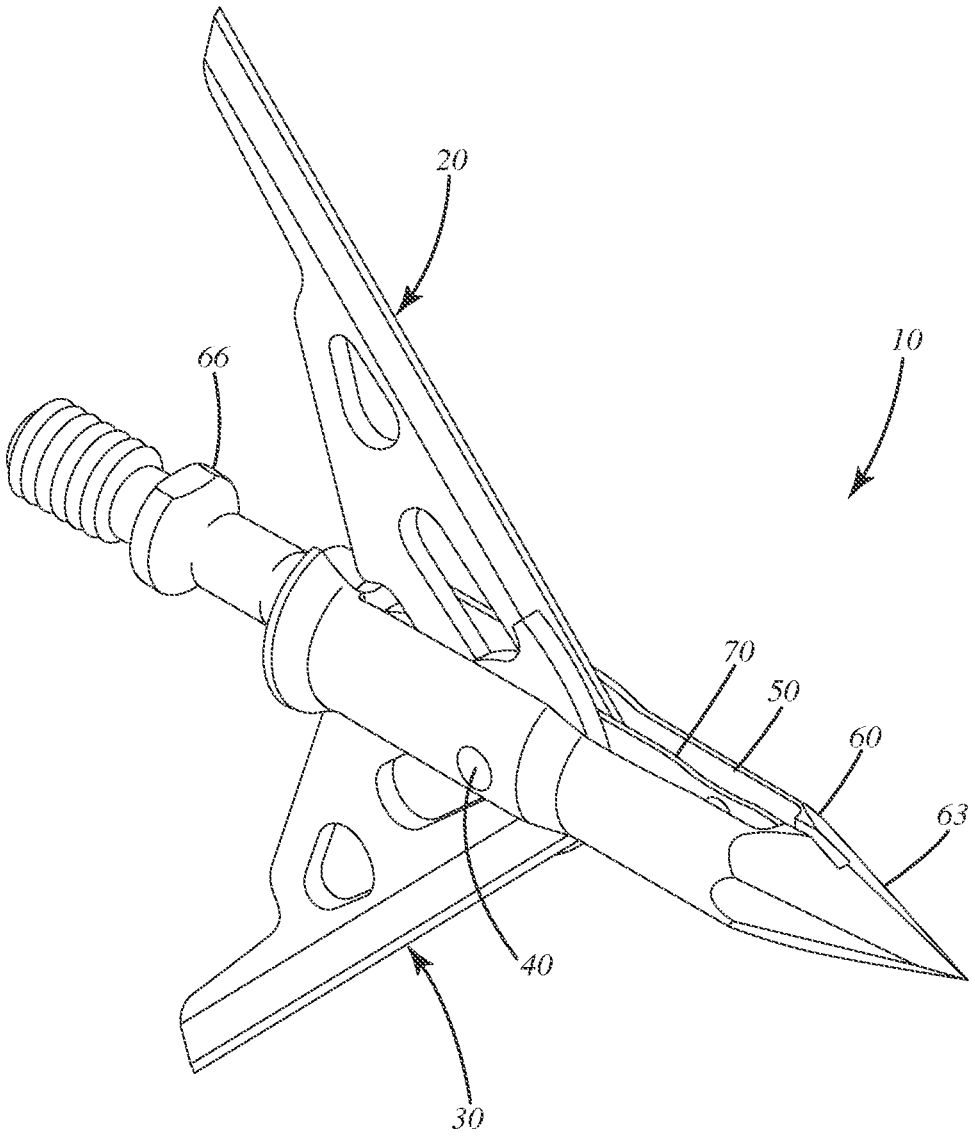
FIG. 8 is a perspective view of the broadhead in an open mode.
Figure 9:
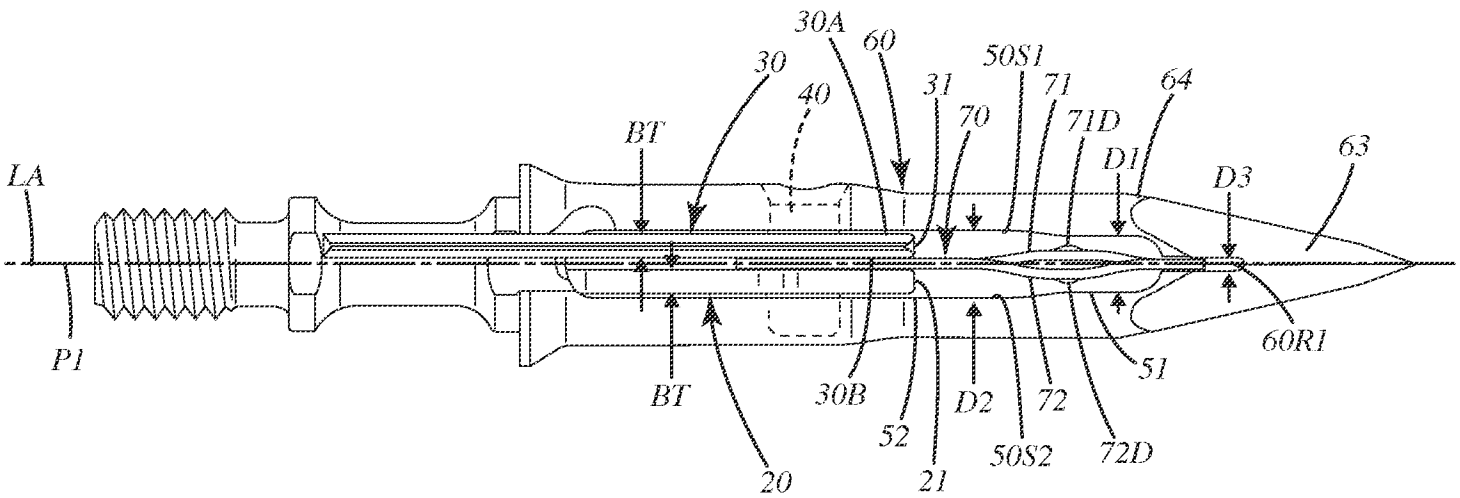
FIG. 9 is a side view of the broadhead in the open mode.
Figure 10:
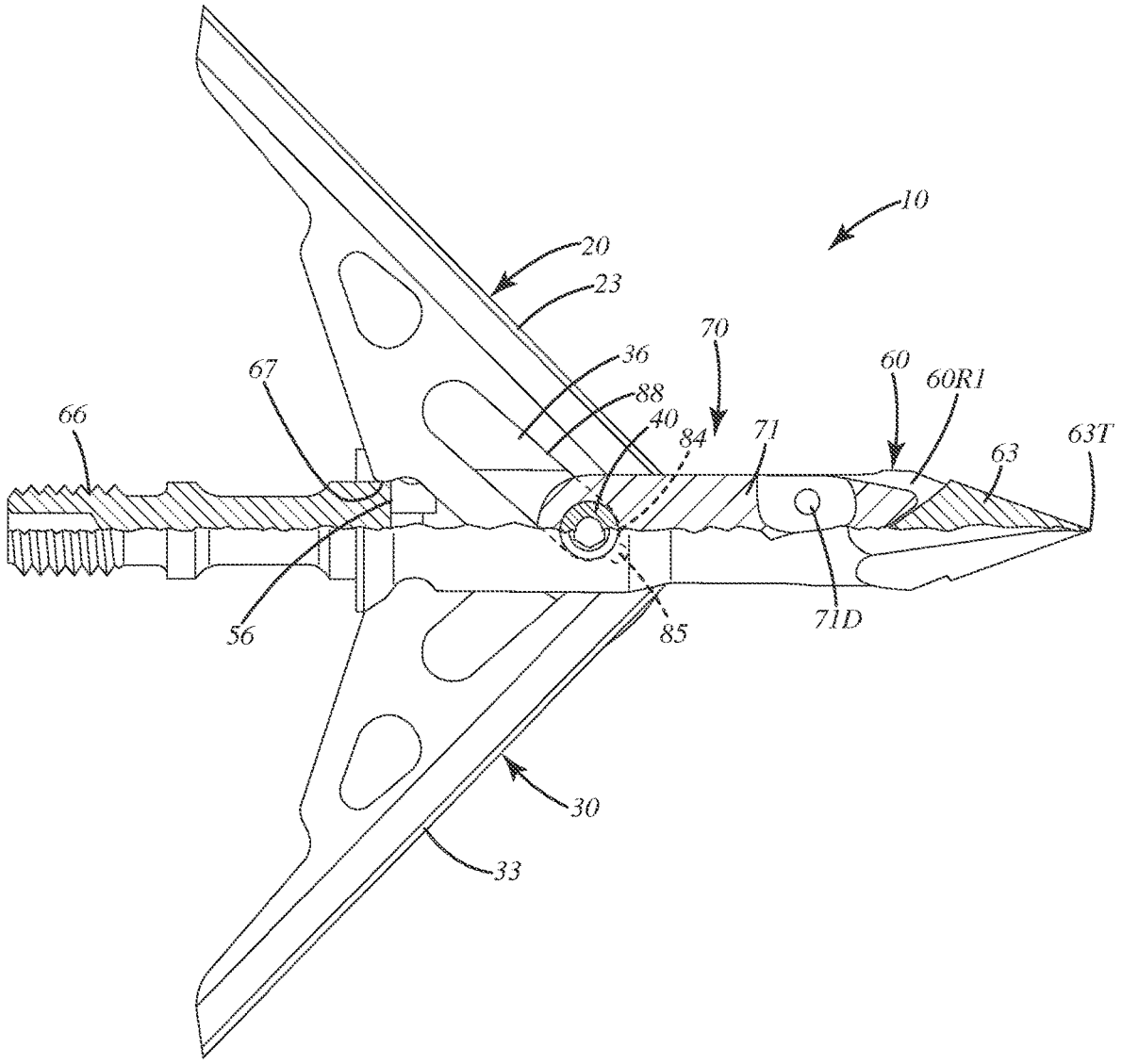
FIG. 10 is a partial section view of the broadhead in the open mode.

The closed mode of the broadhead is shown generally in FIGS. 1-6, while the open mode is shown in FIGS. 8-10. In comparing the closed mode to the open mode, it is evident that the blades 20 and 30 slide and/or move relative to the connecting pin or shaft 40 within a blade slot 50 defined by a ferrule 60 of the broadhead 10.

Figure 1:
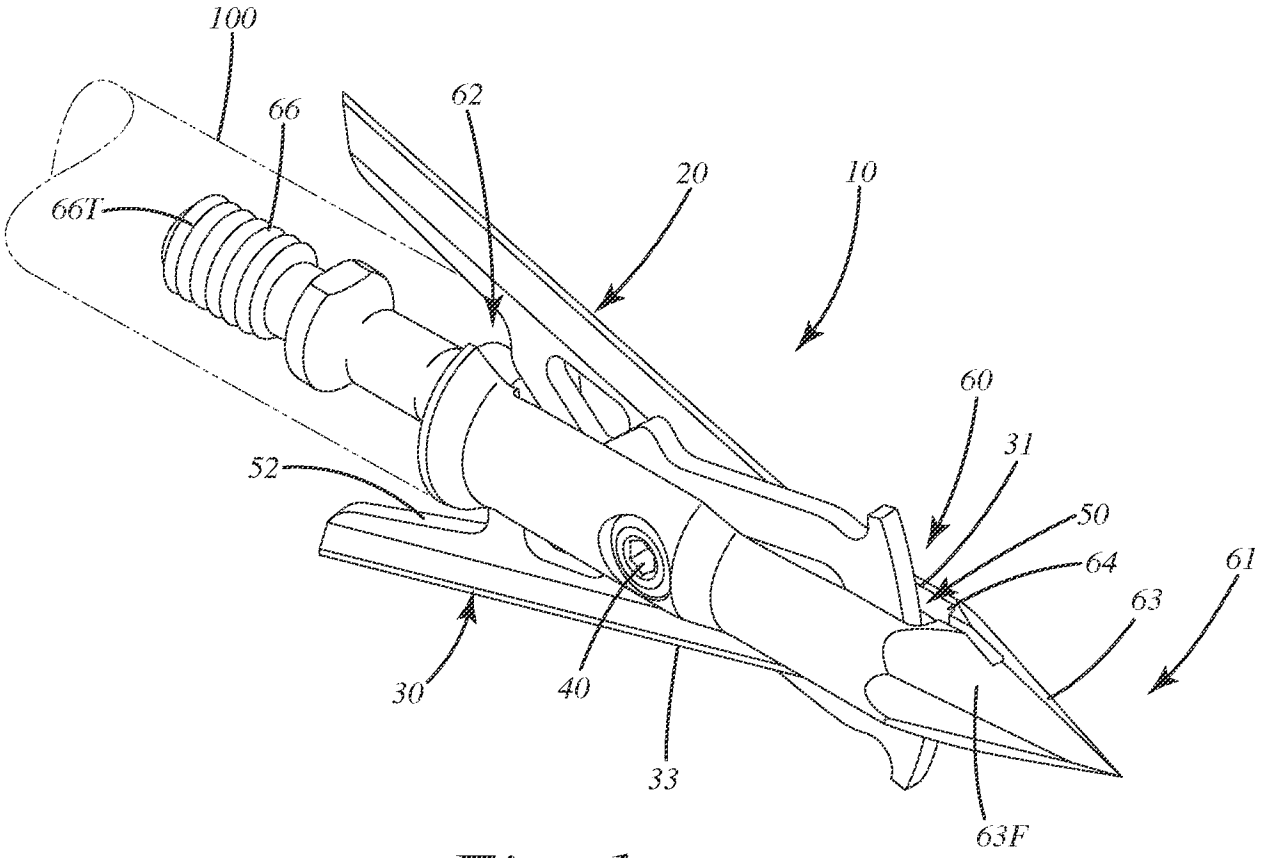
FIG. 1 is a perspective view of the broadhead of a current embodiment in a closed mode.
Figure 2:
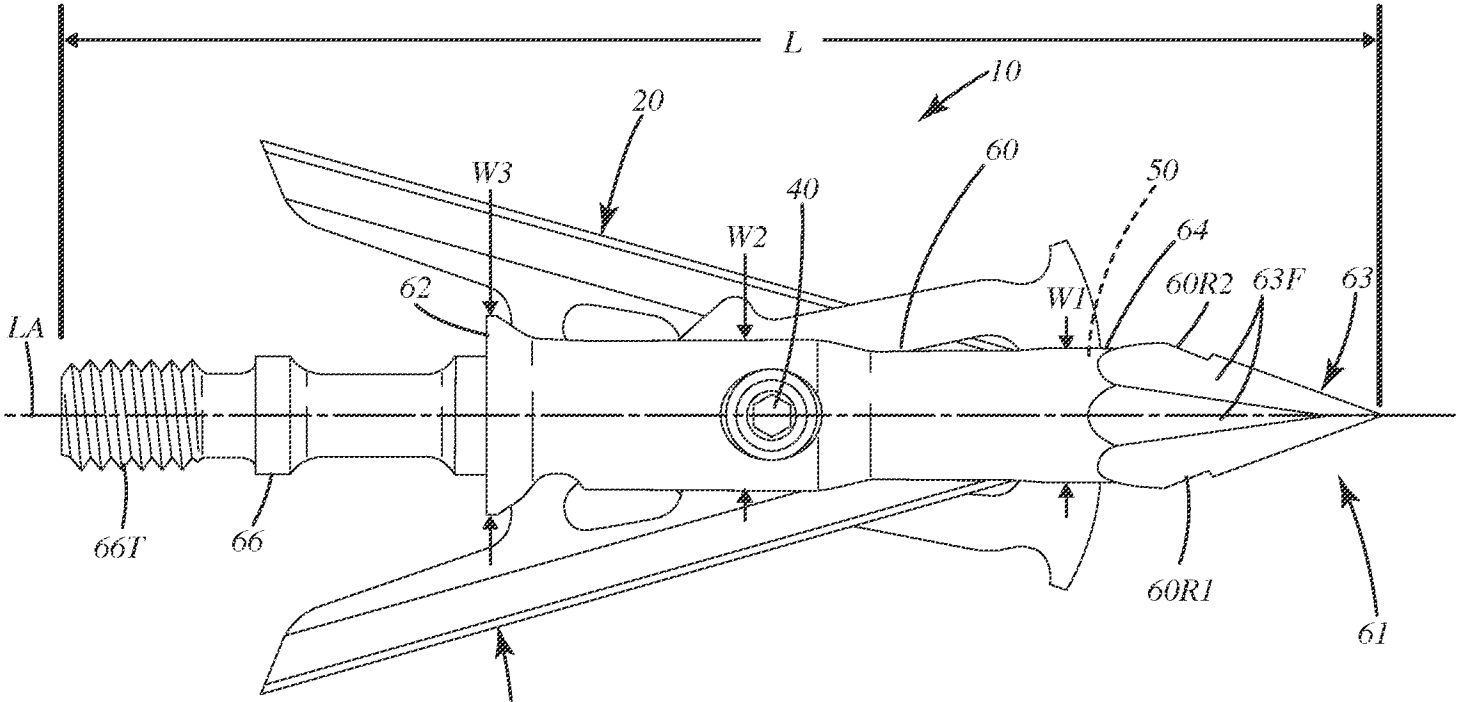
FIG. 2 is a top view of the broadhead in the closed mode.

As shown in FIGS. 1 and 2, the broadhead can include a ferrule 60. The ferrule 60 can include a first end 61 and a second end 62. The first end 61 can include and/or form a tip 63. The tip 63 can include multiple facets terminating at a point and designed to penetrate game and/or a target. The facets can transition rearward to a main body 64 of the ferrule. The main body 64, as shown, can be cylindrical toward the tip and flare out or transition at or near the pin 40, which can be stationary and fixed relative to the ferrule. In some cases, the dimension and/or width, optionally corresponding to a diameter of the ferrule, can increase in certain regions as it extends away from the tip. Thus, the width of the slot 50 through the length L of the broadhead 10 optionally can only increase in as it extends away from the tip 63. As example, the width W1 can be less than a second width W2 and a third width W3, which are each farther away from the tip 63 than the first width W1. Of course, in other applications, the width W1, W2 and W3 can vary throughout the length L, or can be greater than, less than and/or equal to one another depending on the application.

Figure 3:
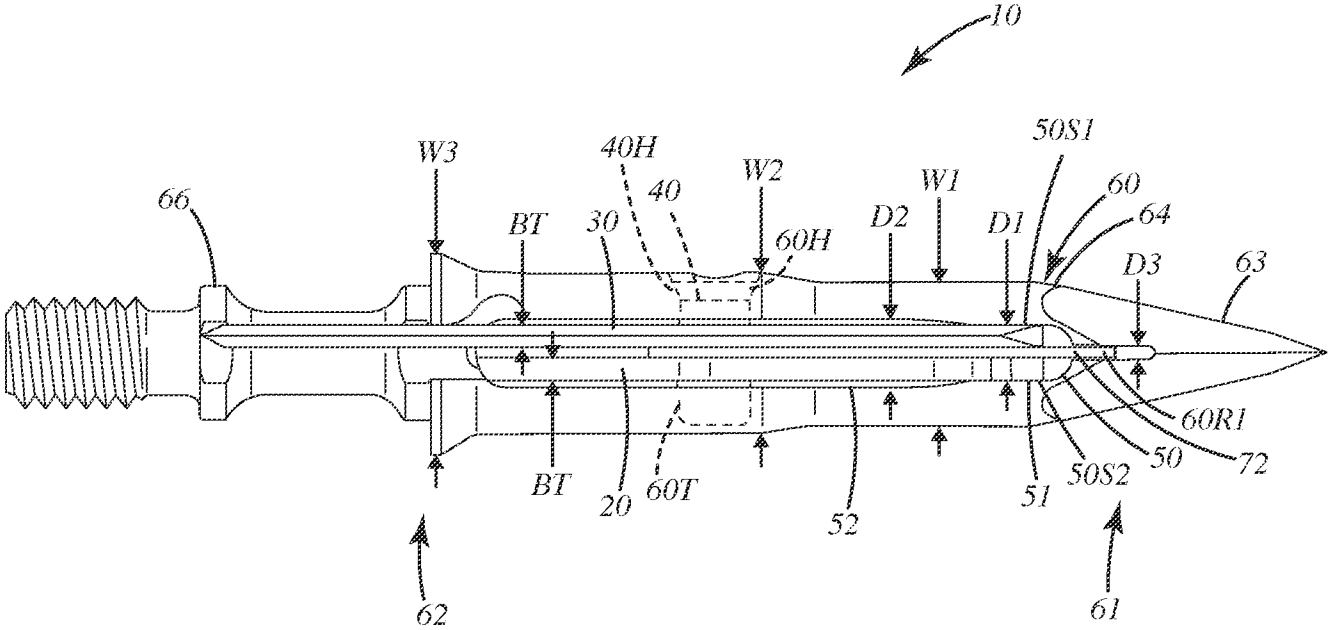
FIG. 3 is a side view of the broadhead in the closed mode.

At the second end 62 of the ferrule, as shown in FIGS. 1-3, the broadhead 10 can include a stem 66. The stem 66 can include threads 66T which can thread into the arrow 100 to secure the broadhead 10 to the arrow 100. The stem 66 can come in a variety of lengths and diameters to fit a variety of different diameter and size arrows. The threads 66T can vary as well to fit a variety of inserts of arrow 100.

As mentioned above, the ferrule 60 can define the blade slot 50. The blade slot 50 can extend from a location rearward of the tip 63 in particular the facets 63F of the tip. The slot 50 can be sized and shaped to house the respective blades 20 and 30. The slot optionally does not extend forward or into the tip 63 and/or overlap the facets 63F of the tip 63 located at the first end 61. Of course, in other applications, the slot 50 may indeed overlap and/or extend into the tip 63. The slot as mentioned above can include a side-to-side width W1 that can be transverse and/or orthogonal to the longitudinal axis LA of the broadhead and/or the ferrule. The side-to-side width W1, W2 and W3, or any other width of the blade slot can correspond to a diameter or other maximum dimension of the ferrule. The blade slot, however, also can include one or more depths D1 and D2. As shown in FIGS. 3 and 9, with FIG. 3 showing the broadhead in the closed mode, and FIG. 9 showing the broadhead in the open mode, these depths D1 and D2 can be different. These depths D1 and D2 also are not to be confused with the overall widths W1, W2, W3 etc. of the ferrule 60. For example, these depths D1 and D2 can be taken perpendicular to the widths W1, W2 and W3 shown in FIG. 2. The depths D1 and D2 of the slot 50 also can generally be orthogonal and/or perpendicular to the blades 20 and 30. Indeed, the blades can be stacked one upon the other within the respective depths D1 and D2 in the closed mode and expanded mode.

Optionally, as shown in FIGS. 3 and 9, the first depth D1 of the slot can be adjacent the tip 63 of the ferrule. Depth D2 of the blade slot can be farther rearward of the tip 63 of the ferrule than the first depth D1. As mentioned above, the depth D1 can be less than the depth D2. The depth of the slot can vary from narrow to wide as the slot 50 extends rearward from the tip 63. Further optionally, the depth of the slot can increase from a narrow depth to a wider depth as the slot extends rearward from the tip 63 of the broadhead 10. This depth D1 optionally can alter or change within the cylindrical constant width W1 main body 64 to the second depth D2. in some cases, both of the first depth D1 and second depth D2 can be located in the main body 64 having a width W1. In alternative constructions, the width W1 can change in this main body region, such that the depths D1 and D2 of the slot are in different widths of the ferrule 60.

Optionally, the first depth D1 can be 0.025 inches to 0.900 inches, 0.50 inches to 0.90 inches, 0.75 inches to 0.900 inches, 0.080 inches to 0.90 inches or other depths depending on the thickness of the blades. Further optionally, the second depth D2 can be 0.150 inches to 0.100 inches, 0.125 inches to 0.100 inches, or 0.11 inches to 0.100 inches or other depths depending on the thickness of the blades.

Figure 4:
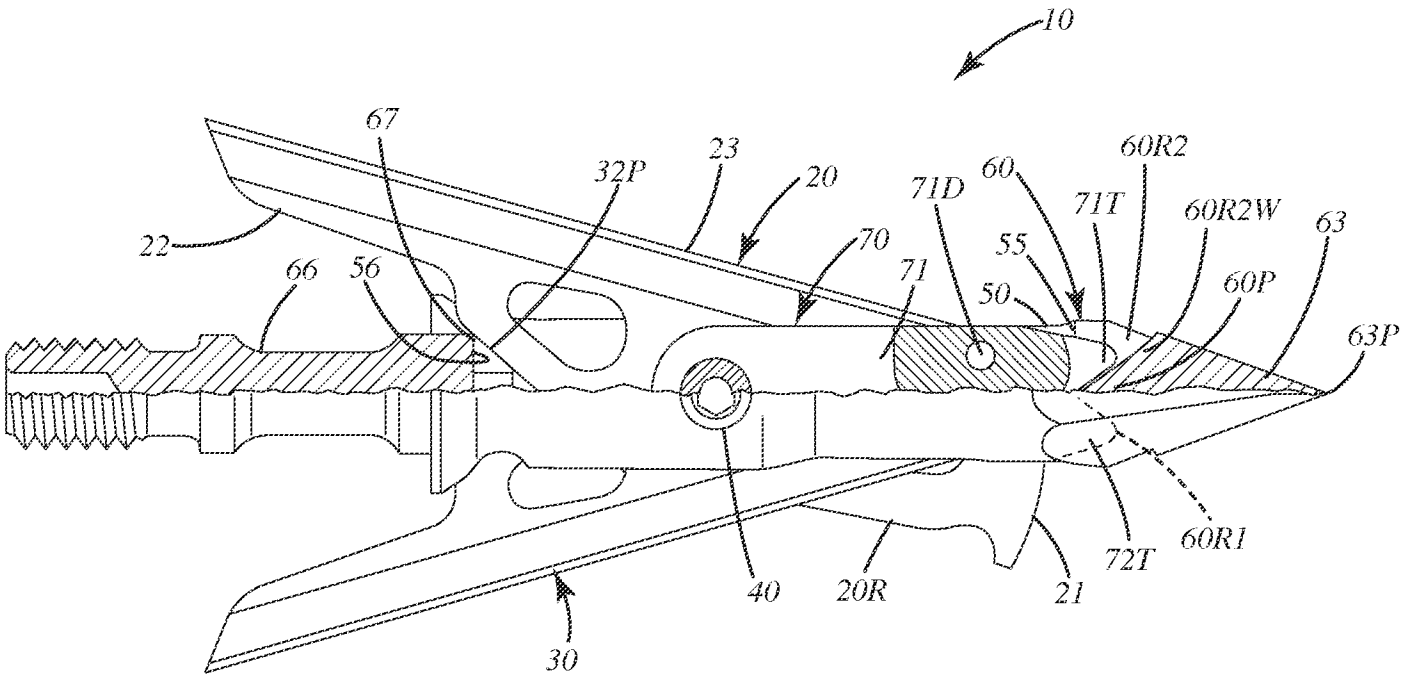
FIG. 4 is a partial section view of the broadhead in the closed mode.

Further optionally, the ferrule 60 can further define one or more retainer recesses 60R1 and 60R2. These retainer recesses can extend into the first end 61 and optionally into the tip 63. These retainer recesses, however, might not house, enclose or conceal therein any part of the blades, which can be entirely disposed in the blade slot 50, which is rearward of the recesses, rather than in the recesses. The recesses shown do not form a part of the blade slot. Moreover, these retainer recesses 60R1 and 60R2 can have a depth D3 that optionally is thinner than the blade thickness BT of either of the blades 20 and 30 as shown in FIG. 3, and therefore, the blades cannot fit within those retainer recesses 60R1 and 60R2. The retainer recesses can extend forwardly from the blade slot 50 and well forward of the pin. As shown in FIG. 4, the blade slot 50 can terminate at a forward edge or wall 55. The retainer recesses however can extend forward of that edge or wall 55 bounding the slot 50 which houses the blades. The retainer slot 60R2 can include a forward wall 60R2W which extends into the tip 63, forward of the forwardmost wall 55 of the blade slot 50.

As mentioned above, the blade slot 50 can be an elongated slot extending rearward from the tip 63. The blade slot can be extended by the ferrule 60 rearward to the stem 66 of the ferrule 60. The blade slot 50 can terminate at a rearward wall 56 as shown in FIG. 4. The ferrule can include a rearward edge 67 that can contact a rearward edge 22 of blade 20. This contact however, can be only a point contact with zero holding force exerted on the blade 20 via this contact. In other words, the contact between the rearward edge 22, the blade and the edge or wall 67 of the ferrule produces and provides zero holding force against the blade 20 of the other blade 30 to hold those blades in the retracted or closed mode. Instead, all the force to hold the blades in the closed mode is provided by the retainer 70 as described below.

Figure 7:
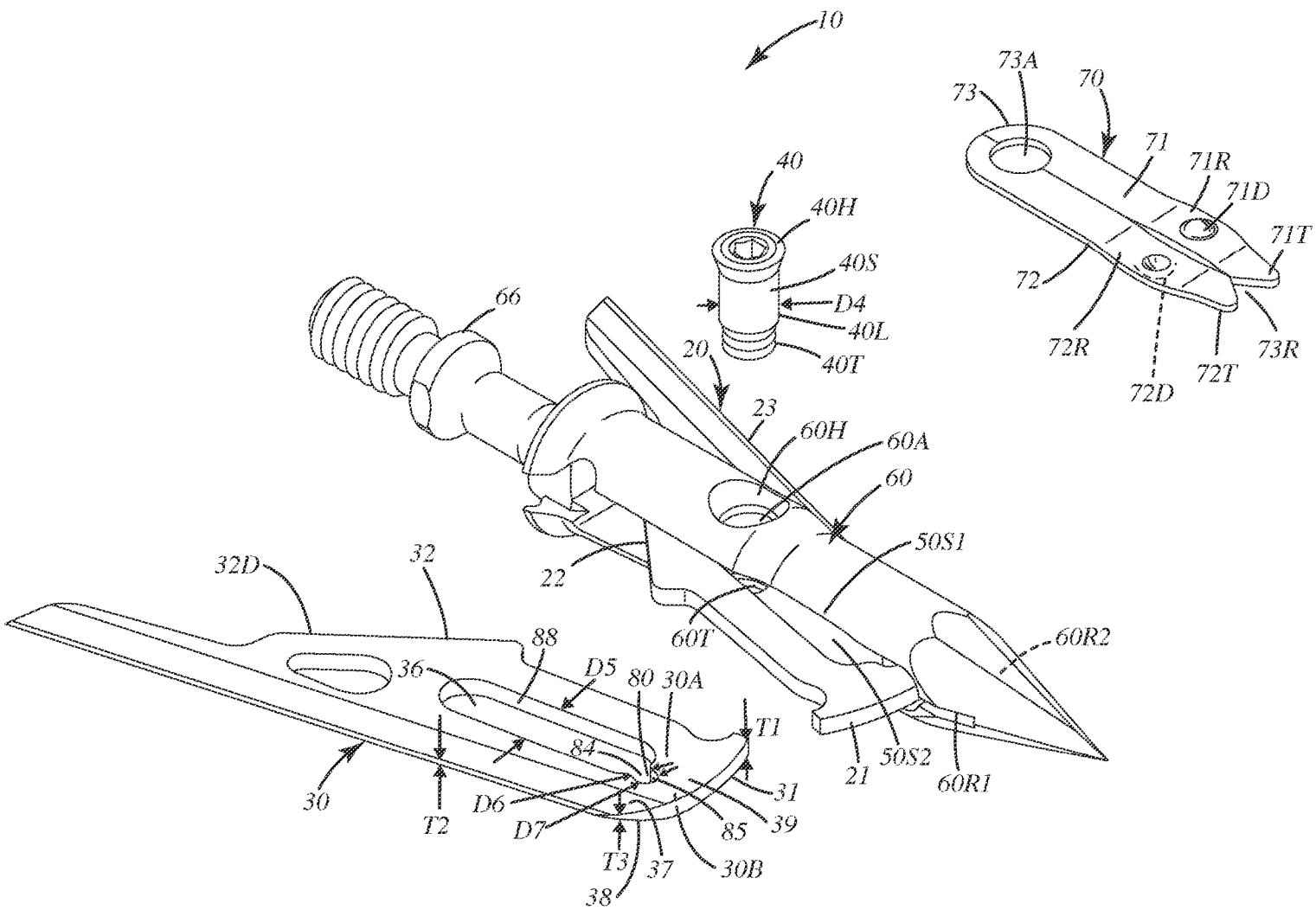
FIG. 7 is a partially exploded view of the broadhead.

As shown in FIGS. 1, 4 and 7, the broadhead 10 can include a blade retaining pin 40. This blade retaining pin can extend through the ferrule, optionally being of a length less than the width W2. The retaining pin optionally can be in the form of a fastener that is threaded at least partially into the ferrule as shown in FIG. 7. Of course, in other applications, the pin can be in the form of a roll pin, a dowel, a friction fit pin, an elongated tube or some other structures. The pin as shown in FIG. 7, however, can be in the form of a shoulder screw. The shoulder screw can include a head 40H, a shaft 40S, a shoulder 40L, and a threaded end BT including threads. The ferrule 60 optionally can include a recess 60H that is also tapered similar to the head 40H. The ferrule can include a through aperture 60A, through which the shaft 40S fits. The opposite side of the ferrule across the depth D2 can include a threaded portion 60T which the threads 40T of the fastener mate to secure the pin to the ferrule. The shoulder 40L can engage and stop against the sidewall 50S2 when the fastener is threaded into the threads of the ferrule. The pin can be disposed in the blade slot 50 and generally extend through the ferrule in the second region 52 of the blade slot where the blade slot is of the second or greater depth D2 than the first depth D1 of the blade slot. The shaft 40S can include a diameter D4 that is less than a width D5 of one or more elongated slots in the respective blades 20 and 30. Accordingly, the blades 20 and 30 slide and deploy freely with regard to the pin 40.

The width D5 of the elongated opening optionally can be of a constant width as shown such that the blade does not free float relative to the pin. Of course, in other applications, the opening 36 can have varying widths D5 along the length and/or at the ends of the slot to provide a free-floating action of the blade. Moreover, the ends of the slot, as shown, can be the same shape and general corresponding dimension as the pin 40. Of course, in other applications, the ends may vary and have different shapes than that of the cylindrical or rounded shaft 40S as shown.

As mentioned above and shown in FIGS. 1, 2 and 7, the blades can be secured to the ferrule 60 via the pin 40. The blades, as shown, can include two blades, that is, a first blade 20 and a second blade 30. The blades 20 and 30 can be adjacent on another in the blade slot 50. The blades can be disposed between the first slot sidewall 50S1 and second slot sidewall 50S2. The blades also can be simultaneously disposed in the first region 51 and the second region 52 of the blade slot 50 having the corresponding depths D1 and D2 as described above. Optionally, the blades are disposed in both regions 51 and 52, having the respective depths D1 and D2 in the closed mode as shown in FIG. 3. In the open mode shown in FIG. 9, the blades have exited the first region 51 having the first depth D1 and are only in the second region 52 having the second depth D2. As described below, with the movement of the blades from the first region 51 out of the first depth D1, in particular the forwardmost or impact edges or portions of the blades moving out of this region 51, and into the wider, greater depth D2 second region 52, can help shed the outward force of the retainer 70 as described below on those blades. As a result, the blades moving in the second region 52, once out of the first region, can move more freely open without substantial engagement with the respective blades' sidewalls 50S1 and 50S2 as they are transitioning to the open mode shown in FIG. 9.

The blades 20 and 30 can be generally identical so only the first blade 30 will be described here. In particular, as shown in FIG. 7, the blade 30 can include an impact edge or forward edge 31, a rearward edge 32 which can comprise a plurality of independent separate contours and/or edges, and a cutting edge 33. The impact edge 31 and rearward edge 32 can include a thickness T1. This thickness can be generally uniform through the impact edge 31 and the rearward edge 32, and can extend between side surfaces 30A and 30B of the blade. The impact edge 31 can be configured to engage the target and upon such engagement the blade 30 is forced rearward within the blade slot 50, sliding such that the elongated opening 36 moves relative to the pin 40 and the blade 30 moves outward. This blade 30, however, optionally is not connected to the other blade 20, so their movement is separate. The impact edge 31 in the closed mode shown in FIG. 1 can be on one side of the ferrule 60 while the cutting edge 33 and rearward edge 32 of the blade 30 can extend from the opposite side of the ferrule. Likewise, the other impact edge, cutting edge and rear edge of the other blade 20 can be similarly situated on opposite sides of the ferrule.

Optionally, the rear edge 32 of the blade includes a rear protrusion 32P opposite the cutting edge 33. This protrusion can contact a rearward wall 57 or slot base or edge 67 while the blade 30 is in the closed mode as shown in FIG. 4. However, this contact provides no holding force for the blade to be retained in the retracted or closed mode. Instead, all the force is provided via the retainer 70 engaging the blade. If the retainer 70 is not present, the blade 30 would simply fall out of place and be free to rotate and move, so thus again, the protrusion 32P contacting the slot base or edge 67 optionally does not hold the blade in that closed position.

Figure 12:
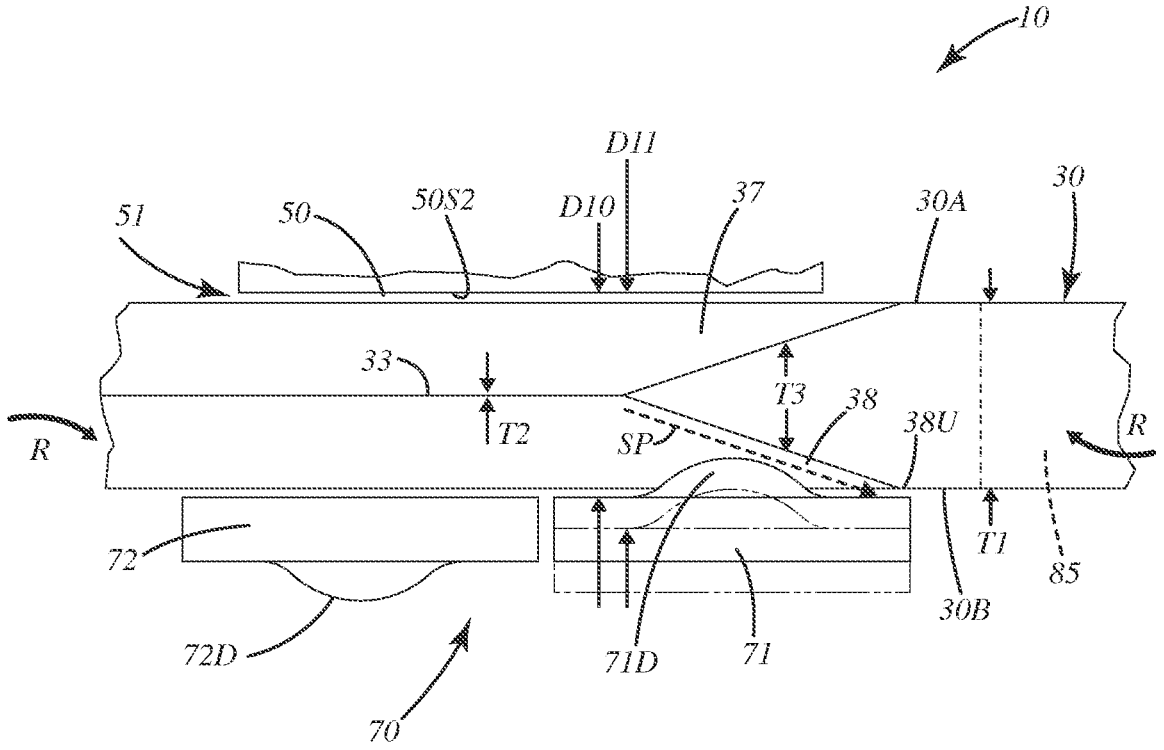
FIG. 12 is another view of the blade being reset from the open mode to the closed mode.

As shown in FIGS. 7 and 12, the cutting edge 33 transitions to one or more ramps 37 and 38. The cutting edge thickness T2 can be less than the thickness T1 between side surfaces 30A and 30B. This thickness T2 of the cutting edge 33 can be such that it can slice and/or cut target material or game features, such as a hide and/or tissue. The ramps 37 and 38 can extend away from the cutting edge 36 and can include a different or varying thickness T3. The varying thickness T3 can be greater than the thickness T2 at the cutting edge 33 and less than or equal to the thickness T1 of the blade between a first side surface 30A and a second side surface 30B of the blade. Although shown as planar surfaces, the ramps 37 and 38 alternatively can be curved contours or steps and can include multiple facets transitioning from the thinner thickness T2 to the thicker thickness T1. The ramps 37 and 38 also can include multiple facets and/or steps transitioning from the cutting edge 33 to the side surfaces 30A and 30B. The ramps optionally can be disposed at an angle depending downward relative to the side surfaces. The angle can be offset relative to the side surface optionally about 1 degree to about 45 degrees, about 15 degrees to about 45 degrees, about 5 degrees to about 35 degrees, about 10 degrees to about 25 degrees, about 15 degrees to about 30 degrees, or other angles depending on the application.

The elongated openings of the blades 20 and 30 can be configured so that the blades form one or more retainer holes 85 to interact with the retainer 70 as described below. The retainer holes 80 can be contiguous and/or continuous with the elongated opening 36 defined by each of the blades. As shown in FIG. 7, the elongated opening 36 optionally can include an inlet 84 that leads into the retainer holes 80, 85. The inlet can be a dimension D6 that is less than the dimension D7 of the retainer holes 80, 85 that is common with it. Of course, the dimensions D6 and D7 can be equal or reversed in some applications. The inlet and retainer hole can each be bounded by a common edge 88, which also optionally extends along the elongated opening. This edge 88 can extend from the first side surface 30A to the second side surface 30B of the blade. This edge and the opening and hole can be formed by stamping the blade to remove a corresponding part of the blade. The edge 88 also can be of the thickness T1 as it extends between the first side surface 30A and second side surface 30B of the blade. The retainer hole 85 optionally can be formed as a portion of a circle as shown, or alternatively of a polygonal, rounded, partial elliptical or other shape depending on the application. Further, although the retainer hole is shown as a through hole extending completely through the blade from the first side surface 30A to the second side surface 3B, this retainer hole can be in the form of a recess or depression, which only extends part way through the thickness T1 and is only partially defined in, for example, the side surface 30A, without extending to the other side surface 30B on the opposite side of the blade. The inlet 84 can be similarly formed, extending only partially through the thickness T1.

Optionally, the retainer hole 85 is defined entirely within the blade and does not form or extend to or within any of the external exterior edges, such as the impact edge 31, the rear edge 32 and/or the cutting edge 33. Further optionally, the retainer hole 85 can be formed as an extension of the elongated opening 36 that receives the pin 40 upon which the blade rides or slides in transitioning from the closed mode to the open mode. Indeed, when the blades are in the open mode, the inlet 84 and the retainer hole 85 can be disposed immediately adjacent the pin 40 as shown for example in FIG. 10. There, the pin 40, in particular the shaft 40S, can close off the inlet 84 and the retainer hole 85 from the remainder of the opening 36 of the blade.

As mentioned above, the broadhead 10 can include a retainer system including a retainer 70. As shown in FIG. 7, this retainer 70 can include a base 73 from which a first arm 71 and a second arm 72 extend. The base 30 optionally can define a pin aperture 73A through which the pin 40 extends and secures the retainer 70 within the blade slot 50. The retainer 70 can be configured to fit between the respective blades 20 and 30, sandwiched between those blades and within the blade slot 50. The pin aperture 73A can be slightly larger than the dimension D4 of the shaft 40S. The arms 71 and 72 can extend away from the aperture 73A, and thus away from the pin 40 when the retainer 70 is installed in the blade slot. The arms 71 and 72 can extend forwardly, away from the pin 40 and toward the tip 63 of the barrel 60, and/or away from the stem 63 of the ferrule.

Figure 6:
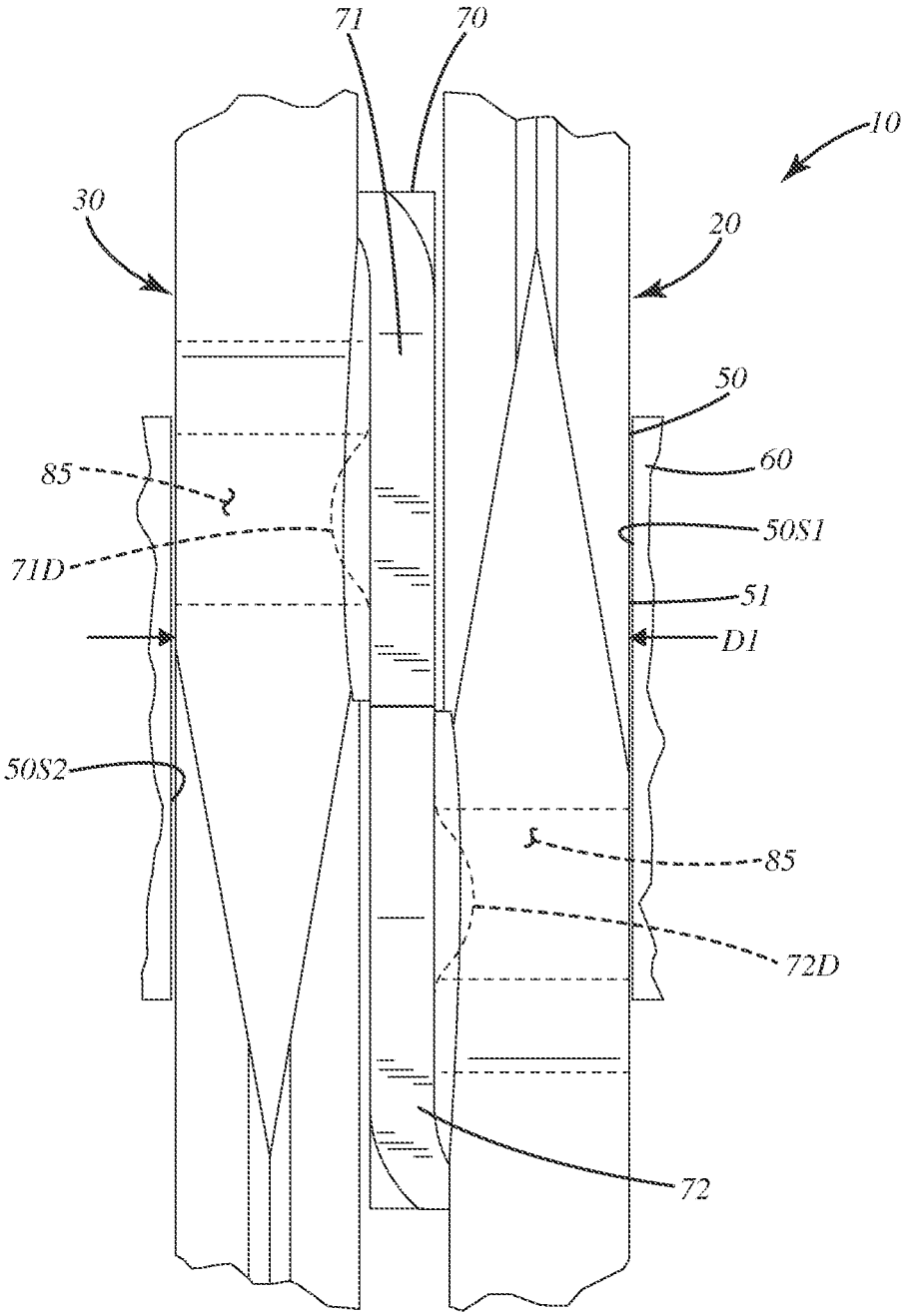
FIG. 6 is a partial front view of retainer dimples registered with respective blades and retainer holes.

Optionally, the retainer 70 can include the first dimple 71D and a second dimple 72D. Of course, more or fewer dimples can be included with a retainer 70. As shown, however, each can be configured to engage respective retainer holes 80, 85 of each of the respective blades 20 and 30. As shown, dimples 71D and 72D can be the form of projections along the retainer, and optionally on each of the respective retainer arms 71 and 72. These dimples can project generally upward and downward from the retainer 70 is shown in FIGS. 6 and 7. The dimples can be in the form of smooth or rounded surfaces. The dimples can be formed in the bent or contoured regions 71R and 72R of the respective arm 71 and 72. These regions 71R and 72R can be bent or generally disposed outward and/or away from a plane P1 extending through the ferrule 60 as shown in FIG. 9. The arms 71 and 72 between the dimples and the pin, however, can lay commonly in that same plane P1 generally within the region 52 of the slot. The first and respective dimples 71D and 72D can be disposed in the slot in the first region 51 having the first depth D1. The dimples can be disposed between the tip 63 and the pin 40. The arms 71 and 72 can project forwardly, between the pin 40 and the tip 63 within the slot. The dimples 71D and 72D optionally can be disposed forward of the second region of the slot having the second or greater depth D2. Of course, in some applications, the dimples can extend rearwardly into this greater depth region 52.

As mentioned above, the ferrule can define retainer recesses 60R1 and 60R2. These retainer recesses can be configured to receive the respective forward ends or tips 71T and 72T of the retainer arms 71 and 72 generally along a forward end of the retainer 70. The respective tips 71T and 72T can be of a thickness that is less than the thickness D3 of the respective retainer recesses 60R1 and 60R2. In some cases, retainer tips 71T and 72T can fit within the respective recesses within the tip 63. Generally, the respective arms can extend beyond the blade slot into the respective retainer recesses. The blades, of course, optionally may never extend into the respective recesses. The respective dimples 71D and 72D, however, can remain rearward of the respective retainer recesses and not disposed within them. When the tips 71T and 72T are disposed in the recesses, the retainer can be further secured within the slot, being held in position via the retainer pin 40 through the base 73 and the retainer tips 71T and 72T being held and trapped within the respective retainer recesses 60R1 and 60R2.

Further optionally, the respective recesses 60R1 and 60R2 can include a projection 60P between them and thus projecting in a recess 73R that is disposed between the tips 71T and 72T of the retainer 70. With this projection or a portion of the tip located within the recess 73R of the retainer, the arms 71 and 72 can be slightly isolated from one another in movement and structure. Moreover, with the projection in the recess 73R, this can prevent rotation of the retainer 70 about the pin 40, thus securing or maintaining it in a position between the pin 40 and the tip 63.

Operation and use of the broadhead 10 will now be described. FIGS. 1-6 generally illustrate a closed mode in which the blades 20 and 30 are not yet deployed. This closed mode can be utilized when the broadhead is being stored, being launched, and/or in-flight, before impact with a target or game. In this closed mode, the retainer 70, the blades and the pin are disposed in the slot. The retainer 70 extends forwardly from the pin 40 with the tips 71T and 72T disposed in the respective retainer recesses. The impact edges 31 and 21 of the respective blades extend on opposite sides of the ferrule 60 from the cutting edges 33 and 23. In this configuration, shown better in FIG. 5, the respective dimples of the retainer are disposed within the respective retainer holes 85 of each of the blades. For example, as shown there, dimple 71D is disposed in the retainer hole 85 of the first blade 30. The second dimple 72D is disposed in the retainer hole of the second blade 20. Each of the respective dimples provide a force on the respective first and second blades to secure the first and second blades in the closed mode within the slot. Moreover, where the forward portions of each of the blades near the impact edges 31 and 21 are disposed in the first region 51 having the decreased depth D1 of the slot, those blades are better pushed outward, against the respective sidewalls 50S1 and 50S2 by the retainer as shown in FIG. 3. This extra push in this region of decreased depth D1 can provide increased friction against the blades, thereby holding them better in position upon launch of the broadhead 10 and an associated arrow 100 from a compound archery bow.

As shown further in FIG. 6, in the closed mode, the first arm 71 can be in contact with the first blade 30, but not the second blade 20. Likewise, the second arm 72 can be in contact with the second arm 20 but not the first blade 30. In this manner, the respective arms and respective dimples interact with only the respective blades, rather than both of the blades. In other applications, the arms and dimples can interact with both blades or single blades in different manners.

As mentioned above, the broadhead 10 is deployable from the closed mode shown in FIGS. 1-6 to the open mode shown in 8-10. The transition from the closed mode to the open mode, however, with the aid of the retainer described herein, does not occur during initial launch and/or flight of the broadhead through the air with an associated arrow. Instead, the interlocking of the dimples and the blades and/or the retainer holding the blades, prevents premature deployment of either of the blades due to excessive forces under acceleration of the broadhead upon initial launch or flying along a trajectory. However, when the broadhead engages a target or game, with the tip 63 penetrating the target or game, thus allowing the impact edges 21 and 31 to also engage target, forces exerted on such impact edges will deploy the blades 20 and 30. As this movement initially occurs, the impact edges and the portion of the blade near the impact edges begins to move rearward in the first region 51 the decreased depth D1. When this occurs, the arms and dimples can bend or move slightly inward toward the plane P1 as shown in FIG. 9. As this occurs, the dimples also exit the respective retainer holes 85 defined by each one of the blades 20 and 30. The dimples can exit these holes and ride over the respective side surfaces of the blades after exiting the retainer holes.

Figure 5:
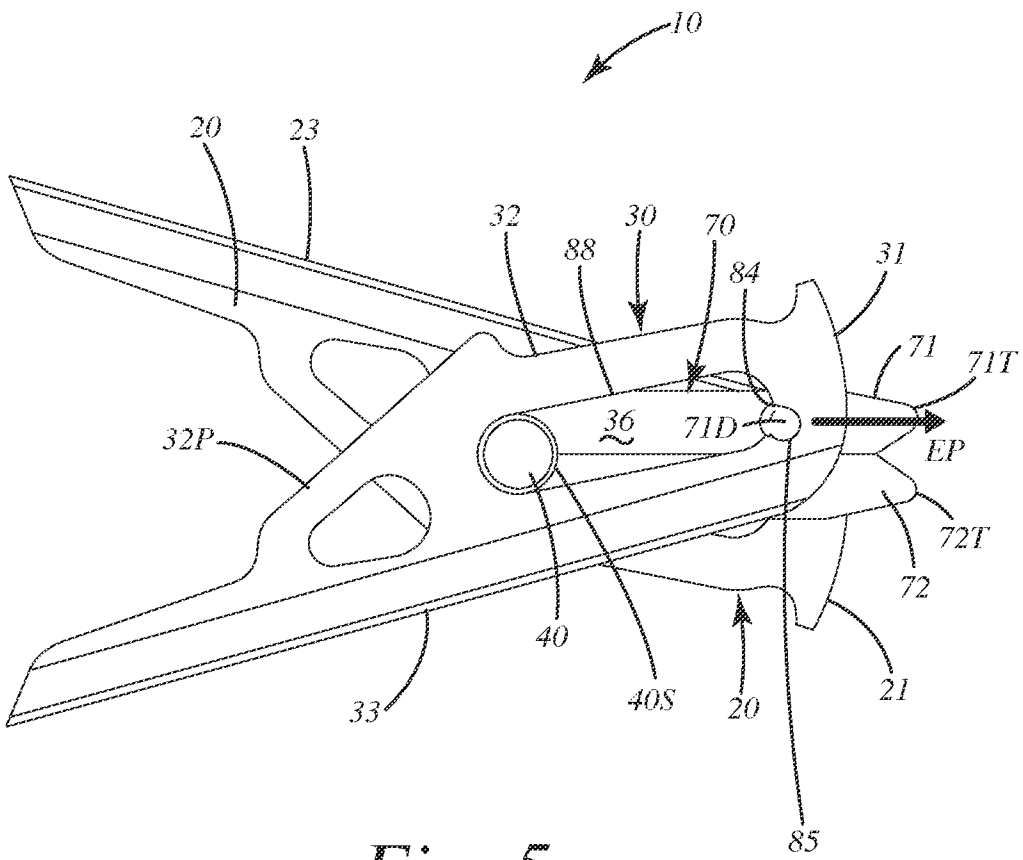
FIG. 5 is a top view of the blades of the broadhead, showing a retainer hole and a retainer including a dimple registered with the retainer hole to secure the blades in the closed mode.

As shown in FIG. 5, when the first blade 30 transitions from the closed mode to the open mode, the blade moves such that the side surface of the blade slides relative to the dimple 71D on an exit path EP, until the impact edge 31 passes beyond the dimple 71D. After the dimple 71D moves past the impact edge 31, the retainer 70 no longer retains or secures the blade 30 in place. The other blade 20 can interact with a corresponding dimple 72D in a corresponding manner with the second dimple 72D on an exit path along the side surface of that blade 20 until it passes beyond the impact edge 21.

The blades continue to move rearward and as the impact edges 21 and 31 of the blades enter the enlarged or wider second region 52 having the greater depth D2, the exterior side surfaces of the respective blades no longer are in close contact with the respective sidewalls 50S1 and 50S2 of the slot. As a result, the blades have less force exerted upon them by the side walls and deploy more easily than when the blades were at least partially disposed in the first region 51 of the slot. The blades also can move about the pin 40 such that the cutting edges extend farther outwardly on their way to the open mode.

As the blades deploy from the closed mode to the open mode, the retainer 70 can remain in place, generally disposed forward of the pin and rearward of the tip. The dimples 71D and 72D of the respective arms also can remain in the generally stationary position between the pin and the tip during both the closed mode and the open mode. The respective dimples also can be prevented from moving with the first blade and with the respective second blade, rearward in the slot during the transition from the closed mode to the open mode.

Optionally, deployment of the blades from the closed mode to the open mode can be accomplished via the application of forces to the impact edges of the respective blades which in turn disengages the retainer from the blades and more particularly the dimples from the respective retainer holes. In some cases, the force applied to the blades, and particularly the impact edges can be optionally at least 4 pounds, at least 5 pounds, at least 6 pounds, about 4 to about 6 pounds, about 3 to about 6 pounds, about 5 to about 6 pounds or other forces depending on the target the broadhead is intended to engage. This relatively higher amount of force to deploy the blades from the closed mode to the open mode can assist in maintaining the broadhead in the closed mode upon launch and during flight of the broadhead with an associated arrow.

The broadhead 10 can be configured so a lower force can be applied by a user to transition the broadhead from the open mode to the closed mode, to recycle the broadhead so it can be shot and used again. The broadhead 10 can be configured to allow the blades to be reset to the closed mode via the application of another force that is less than the force to deploy the blades from the closed mode to the open mode. In some cases, the force applied to the blades to reset the blades to the closed mode, thus engaging the dimples with the retainer holes and holding the blades in the closed position can be optionally less than 3 pounds, less than 2 pounds, less than 1 pound, less than ½ pound, about 3 pounds to 0.1 pounds, about 2 pounds to about 1 pound, or about 1 pound or about ½ pound of force depending on the particular retainer and blade configuration. With this lower amount of force to reset the blades from the open mode to the closed mode, the cutting edges can present less risk of injury to the user and the broadhead can be more easily returned to the closed mode for additional use.

A method of using the broadhead 10 of the current embodiments to convert the broadhead from the open mode to the closed mode generally can include providing that broadhead, moving a first blade so that a ramp of the blade engages a first dimple, such that the first dimple rides along the ramp along a path, and aligning a first retainer hole with the first dimple so that the first dimple at least partially enters the first retainer hole and secures the first blade in a closed mode. The method can optionally include moving the first blade so that a blade side surface engages the first dimple such that the first dimple rides along the side surface along the path before aligning with the retainer hole. The method can optionally include flexing an arm of the retainer as the first dimple moves along the path, wherein the arm flexes more when the side surface engages the first dimple than when the ramp engages the first dimple.

Figure 11:
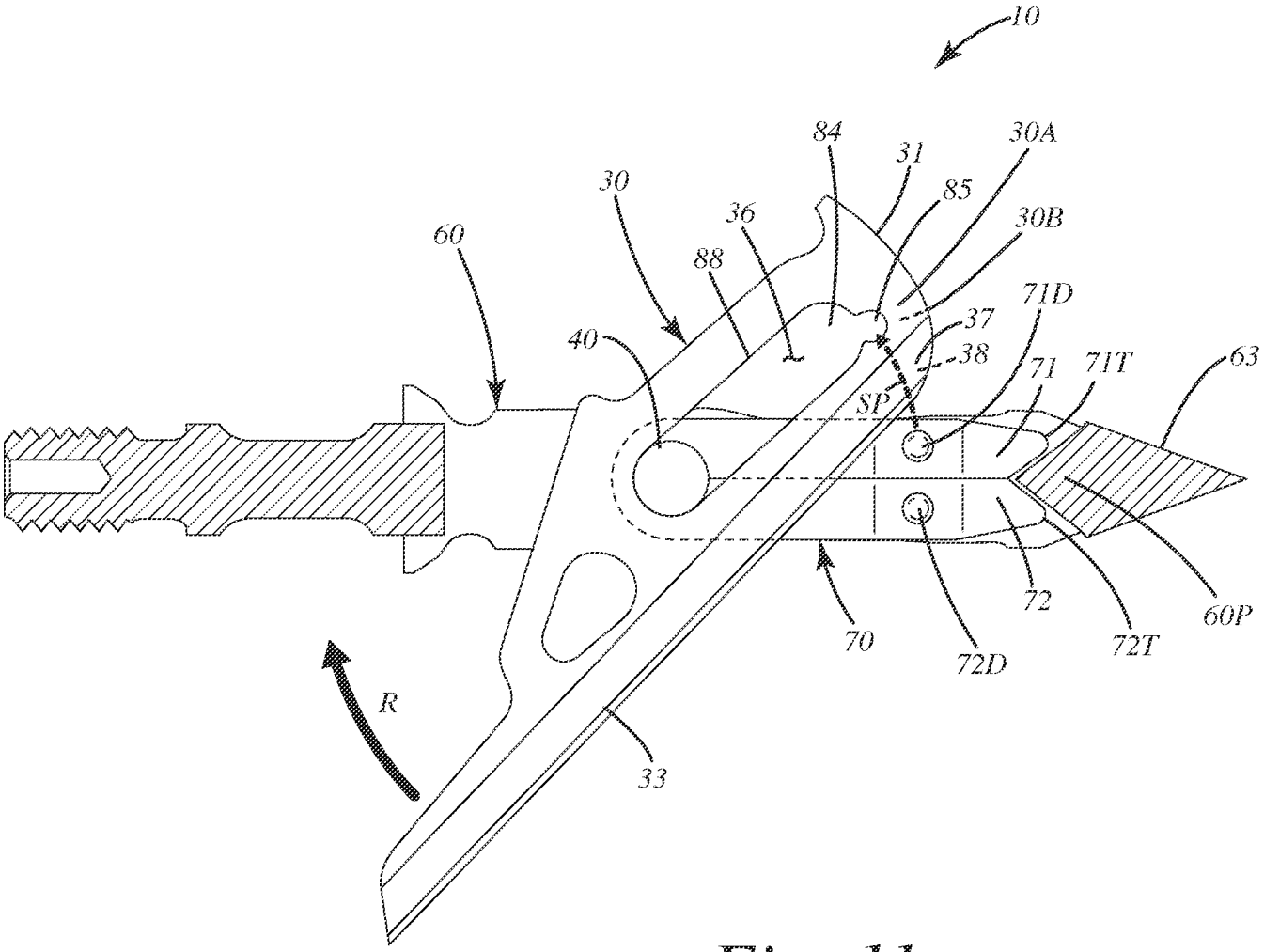
FIG. 11 is a view of a blade being reset from the open mode to the closed mode.

More particularly, an example of resetting the blade 30 relative to the retainer 70 and thus the broadhead 10 is shown in FIGS. 11 and 12. There, the blade 30 is moved forward so that the pin 40 engages the rearward portion of the opening 36 defined by the blade 30. The blade 30 is rotated in direction R. As a result, the forward end of the blade near the tip 63 enters the region 51 of the slot 50. In so doing, the ramp 38 of the blade adjacent the cutting edge 33 engages the first dimple 71D and thus the arm 71 and retainer 70 in general. In some cases, the dimple 71D might first engage the cutting edge 33 on the setting path SP depending on the configuration of the blade and orientation relative to the dimple 71D. While on the setting path SP, the blade ramp 38 slides relative to the first dimple 71D, with the first dimple 71D riding along (although remaining relatively stationary in the slot 50) the ramp 38. As the blade moves relative to the dimple 71D, the dimple engages the blade along the setting path SP, generally moving toward the retainer hole 85 defined by the blade 30. As the blade continues to rotate, it moves the ramp relative to dimple 71D. The dimple 71D optionally can transition up and along the ramp, moving farther and farther away from the sidewall 50S2 as it does so.

In some cases, where the retainer hole 85 is distal from the upper end 38U of the ramp as shown in FIG. 12, the dimple can also transition to and then ride along the side surface 30B of the blade 30. As the blade rotates in direction R, the side surface 30B can move relative to and engage the first dimple 71D. In so doing, the dimple 71D can transition from a portion of the blade that is of the thickness T2 at or near the cutting edge 33, to the thickness T3 of the ramp which thickness T3 may vary, to the thickness T1 of the blade between the respective side surfaces 30A and 30B. As this occurs, the dimple 71D can move farther from the sidewall, in which case, the arm 71 can be bent, flexed and/or compressed to store energy therein sufficient to maintain the blade in the closed mode shown again in FIG. 6.

As the blade moves in direction R, the impact edge 31 and the portion of the blade adjacent the impact edge also can enter the first region 51 of the slot 50. Eventually, moving along the second path SP, the dimple 71D can align with the retainer hole 85 and vice versa. Upon partial or full alignment, the dimple 71D can at least partially or fully enter the retainer hole 85 and thus secure the first blade 30 in the closed mode as shown in FIG. 6. When the dimple 71D enters the retainer hole 85, all or a portion of the dimple can engage the edge 88 that forms the boundary of the retainer hole.

Optionally, when the dimples 71D or 72D of the respective blades 30 and 20 aligns with, registers with, and/or enters a corresponding retainer hole 85 of the blades, that action can provide a tactile and/or audible feedback. For example, when the first dimple 71D enters the retainer hole 85 of the blade 30, the dimple and/or arm can move rapidly toward and collide with or engage the retainer hole boundary or edge, or the side surface of the blade, producing an audible click or snap to the user. This in turn can verify for the user that the blade is secured in the closed mode via the retainer 70 engaged with the respective blade. A user of the broadhead also or alternatively may feel a slight vibration in the blade and/or ferrule, when the respective dimple enters the respective retainer hole, thereby providing a tactile feedback to the user, thus confirming that the blade is secured in the closed mode and ready for another use of the broadhead.

Further optionally, as the dimple moves along the second half SP, the arm 71 of the retainer 70 can flex, bend and/or move different degrees. For example, the arm 71 can flex and optionally deflect more or to a greater degree when the side surface 30B of the blade engages the first dimple 71D than when the ramp 38 and/or cutting edge 33 engage the first dimple 71T. This is shown in FIG. 12. For example, where the dimple engages the ramp 38 along the setting path SP, the arm can be at, or deflect or move, so the arm 71 is a distance D10 from the sidewall 50S2. Where the dimple continues to engage the blade along the setting path SP the dimple can transition to and engage the side surface 30B. When this occurs, the dimple and arm move away from the sidewall, to a distance D11 from that sidewall 50S2. This distance D11 can be greater than the distance D10. The arm and retainer in general can thus flex, bend or move more when the dimple or arm engage the side surface 30B of the blade than when the dimple or arm engage the cutting edge or ramp.

As the first dimple 71D rides along the ramp or vice versa, that movement gradually bends or flexes the retainer arm 71 or otherwise modifies or stores energy in the retainer 70. Due to this gradual flexing or bending, via engagement and use of the ramp, the dimple and retainer arm are not abruptly moved, and as a result, the amount of force to set the dimple in the retainer hole, or otherwise engage the dimple with a portion of the blade, to hold the blade in the closed mode can be decreased relative to a blade setting condition where the dimple does not engage a ramp and/or cutting edge—for example, where the dimple moves along a setting path where the blade engages an edge of the blade having the full thickness T1. In turn, the amount of force to set the blade and return it to the closed mode can be less than the amount of force to deploy the blade from the closed mode. It also will be appreciated that as the blade surfaces and ramp engage the arm 71 in the dimple 70 1D, the dimple can effectively push portions of the blade within the first region 51 toward and/or against the respective sidewalls of the blade slot, which in turn creates an opposing force from the sidewall on the blade to further secure the blade in the closed mode. Of course, the other blade 20 can be converted to the closed mode from the open mode in a similar manner, engaging the second arm 72 and second dimple 72D respectively in corresponding manner and operation. Optionally, the blade, and in particular, the cutting edge, ramp and side surface of the blade can engage the dimple forward of the pin 40 and rearward of the tip 63, as the impact edge of the blade enters the blade slot from a side of the ferrule opposite the side of the cutting edge that extends from the ferrule.

Although the different elements and assemblies of the embodiments are described herein as having certain functional characteristics, each element and/or its relation to other elements can be depicted or oriented in a variety of different aesthetic configurations, which support the ornamental and aesthetic aspects of the same. Simply because an apparatus, element or assembly of one or more of elements is described herein as having a function does not mean its orientation, layout or configuration is not purely aesthetic and ornamental in nature.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation (s).

In addition, when a component, part or layer is referred to as being "joined with," "on," "engaged with," "adhered to," "secured to," or "coupled to" another component, part or layer, it may be directly joined with, on, engaged with, adhered to, secured to, or coupled to the other component, part or layer, or any number of intervening components, parts or layers may be present. In contrast, when an element is referred to as being "directly joined with," "directly on," "directly engaged with," "directly adhered to," "directly secured to," or "directly coupled to" another element or layer, there may be no intervening elements or layers present. Other words used to describe the relationship between components, layers and parts should be interpreted in a like manner, such as "adjacent" versus "directly adjacent" and similar words. As used herein, the term "and/or" includes any and all combinations of one or more of the associated listed items.

The above description is that of current embodiments of the invention. Various alterations and changes can be made without departing from the broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, any combination of X, Y and Z, for example, X, Y, Z; X, Y; X, Z; Y, Z, and/or any other possible combination together or alone of those elements, noting that the same is open ended and can include other elements.

Reference throughout this specification to "a current embodiment" or "an embodiment" or "alternative embodiment" means that a particular feature, structure, or characteristic described in connection with the embodiment is included in at least one embodiment herein. Accordingly, the appearance of the phrases "in one embodiment" or "in an embodiment" or "in an alternative embodiment" in various places throughout this specification are not necessarily all referring to the same embodiment. Furthermore, the particular features, structures, or characteristics may be combined in any suitable manner in one or more embodiments.

What is claimed is:

1. An expandable archery broadhead comprising:

a ferrule including a forward tip and a stem configured to join the ferrule with an arrow, the ferrule defining a slot having a depth and a width, the slot bounded by a first slot sidewall;

a first blade movably disposed in the slot, the first blade including an impact edge, a cutting edge and a rearward edge opposite the cutting edge, the first blade defining an elongated opening continuous with an inlet extending to a first retainer hole defined by the first blade;

a pin extending through the elongated opening and secured to the ferrule so that the first blade is moveably secured to the ferrule in the slot; and a retainer disposed in the slot and including a first arm having a first dimple, the first dimple being forward of the pin and rearward of the impact edge when the first blade is in a closed mode;

wherein in the first dimple is disposed in the first retainer hole providing a force on the first blade to secure the first blade in the closed mode in the slot.

2. The expandable archery broadhead of claim 1, wherein the depth of the slot includes a first depth in a first region adjacent the tip of the ferrule, wherein the depth of the slot includes a second depth in a second region rearward of the first depth, wherein the second depth is greater than the first depth.

3. The expandable archery broadhead of claim 2,
wherein the first blade includes a first surface adjacent the impact edge,
wherein the first surface is free from contact with the first slot sidewall when the first surface is within the slot in the second region of the second depth so that the first blade deploys to the open mode.

4. The expandable archery broadhead of claim 1,
wherein the depth of the slot varies from narrow to wide as the slot extends rearward from the tip.

5. The expandable archery broadhead of claim 4,
wherein the dimple is disposed in a first region where the depth of the slot is narrow,
wherein the pin extends through the ferrule in a second region where the depth of the slot is wide.

6. The expandable archery broadhead of claim 1,
wherein the retainer defines a retainer hole,
wherein the pin extends through the retainer hole,
wherein the ferrule defines a retainer recess forward of the slot,
wherein the first arm extends beyond the slot and into retainer recess.

7. The expandable archery broadhead of claim 1:
wherein the retainer includes a base and a second arm extending from the base adjacent the first arm, the second arm including a second dimple.

8. The expandable archery broadhead of claim 7, comprising:
a second blade adjacent the first blade in the slot, the second blade including a second retainer hole,
wherein the second dimple is disposed in the second retainer hole providing a force on the second blade to secure the second blade in the closed mode within the slot.

9. The expandable archery broadhead of claim 7,
wherein the ferrule defines a retainer recess forward of the slot,
wherein at least one of the first arm and the second arm extends beyond the slot and into retainer recess.

10. The expandable archery broadhead of claim 1,
wherein the elongated opening, the inlet and the first retainer hole are continuous with one another and bounded by a common edge that extends along the elongated opening, the inlet and the first retainer hole.

11. An expandable archery broadhead comprising:
a ferrule;
a first blade movably disposed in the slot, the first blade including an impact edge, a cutting edge, a rearward edge opposite the cutting edge and an elongated opening;
a pin extending through the elongated opening and secured to the ferrule so that the first blade is moveably secured to the ferrule in the slot; and
a retainer disposed in the slot and including a first dimple;
wherein the first dimple engages the first blade providing a force on the first blade thereby retaining the first blade in a closed mode,
wherein the first blade rearwardly slides from the closed mode to an open mode so that the cutting edge extends outward from the ferrule as the first blade and the elongated opening slide relative to the pin.

12. The expandable archery broadhead of claim 11,
wherein the first dimple is forward of the pin and rearward of the impact edge when the first blade is in a closed mode.

13. The expandable archery broadhead of claim 11, comprising:
a second blade adjacent the first blade in the slot,
wherein the first blade includes a first retainer hole,
wherein the second blade includes a second retainer hole,
wherein the retainer includes a base, a first arm and a second arm extending from the base adjacent the first arm, the second arm including a second dimple,
wherein the second dimple is disposed in the second retainer hole providing a force on the second blade to secure the second blade in the closed mode within the slot.

14. An expandable archery broadhead comprising:
a ferrule defining a slot;
a first blade movably disposed in the slot, the first blade including an impact edge, a cutting edge, a rearward edge opposite the cutting edge and an elongated opening;
a pin extending through the elongated opening and secured to the ferrule so that the first blade is moveably secured to the ferrule in the slot; and
a retainer disposed in the slot and including a first dimple,
wherein the first dimple engages the first blade providing a force on the first blade thereby retaining the first blade in the closed mode,
wherein the elongated opening is continuous with a a-first retainer hole defined by the blade,
wherein the elongated opening and the first retainer hole are bounded by a common edge that extends along the elongated opening and the first retainer hole,
wherein the first dimple engages the first blade by at least partially entering the first retainer hole to secure the first blade in the closed mode.

15. An expandable archery broadhead comprising:
a ferrule defining a slot;
a first blade movably disposed in the slot, the first blade including an impact edge, a cutting edge, a rearward edge opposite the cutting edge and an elongated opening;
a pin extending through the elongated opening and secured to the ferrule so that the first blade is moveably secured to the ferrule in the slot; and
a retainer disposed in the slot and including a first dimple,
wherein the first dimple engages the first blade providing a force on the first blade thereby retaining the first blade in the closed mode,
wherein the retainer includes a base and an arm,
wherein the ferrule defines a retainer recess forward of the slot,
wherein the arm extends beyond the slot and into retainer recess,
wherein the first blade never extends into the retainer recess,
wherein the first dimple is rearward of the retainer recess.

16. An expandable archery broadhead comprising:
a ferrule defining a slot;
a first blade movably disposed in the slot, the first blade including an impact edge, a cutting edge, a rearward edge opposite the cutting edge and an elongated opening;
a pin extending through the elongated opening and secured to the ferrule so that the first blade is moveably secured to the ferrule in the slot; and
a retainer disposed in the slot and including a first dimple,
wherein the first dimple engages the first blade providing a force on the first blade thereby retaining the first blade in the closed mode, wherein the slot includes a first region having a first depth, wherein the slot includes a second region having a second depth, wherein the first depth is less than the second depth, wherein the first dimple is in the first region, whereby the first dimple engages the first blade in the first region, but not the second region, to secure the first blade in the closed mode.

17. An expandable archery broadhead comprising:

a ferrule defining a slot;

a first blade movably disposed in the slot, the first blade including an impact edge, a cutting edge, a rearward edge opposite the cutting edge and an elongated opening;

a pin extending through the elongated opening and secured to the ferrule so that the first blade is moveably secured to the ferrule in the slot; and a retainer disposed in the slot and including a first dimple, wherein the first dimple engages the first blade providing a force on the first blade thereby retaining the first blade in the closed mode, wherein the retainer is joined with the pin and the ferrule to fix the first dimple in a stationary position between the pin and the tip during both the closed mode and an open mode, whereby the first dimple is prevented from moving with the first blade moving rearward in the slot during a transition from the closed mode to the open mode.

18. A method of using an expandable archery broadhead, the method comprising:

providing a ferrule defining a slot with a first blade movably disposed in the slot and a retainer including a dimple disposed in the slot, the first blade including an impact edge, a cutting edge, a rearward edge opposite the cutting edge, and a ramp extending adjacent the cutting edge and transitioning to a side surface of the first blade, the first blade defining a retainer hole;

moving the first blade so that the ramp engages the first dimple along a path on the ramp; and aligning the retainer hole with the dimple so that the dimple at least partially enters the retainer hole and secures the first blade in a closed mode.

19. The method of claim 18 comprising:

moving the first blade so that the side surface engages the first dimple along the path on the side surface before aligning with the retainer hole.

20. The method of claim 19 comprising:

flexing an arm of the retainer, wherein the arm flexes more when the side surface engages the first dimple than when the ramp engages the first dimple along the path.

* * * * *